US006933680B2

(12) United States Patent
Oskorep et al.

(10) Patent No.: US 6,933,680 B2
(45) Date of Patent: Aug. 23, 2005

(54) DECORATIVE LIGHTS WITH AT LEAST ONE COMMONLY CONTROLLED SET OF COLOR-CONTROLLABLE MULTI-COLOR LEDS FOR SELECTABLE HOLIDAY COLOR SCHEMES

(76) Inventors: Frank Joseph Oskorep, 690 Schooner La., Elk Grove Village, IL (US) 60007; John Jeffrey Oskorep, 416 W. Briar Pl., Unit #3, Chicago, IL (US) 60657

( * ) Notice: Subject to any disclaimer, the term of this patent is extended or adjusted under 35 U.S.C. 154(b) by 126 days.

(21) Appl. No.: 10/678,934

(22) Filed: Oct. 3, 2003

(65) Prior Publication Data

US 2004/0066148 A1 Apr. 8, 2004

Related U.S. Application Data

(63) Continuation-in-part of application No. 10/144,149, filed on May 10, 2002, now Pat. No. 6,690,120.

(60) Provisional application No. 60/415,968, filed on Oct. 3, 2002.

(51) Int. Cl.[7] ..... H05B 35/00

(52) U.S. Cl. ..... 315/178; 315/185 R; 315/185 S; 315/292; 315/294; 362/252; 362/806

(58) Field of Search ..... 315/178, 179, 315/183, 184, 185 R, 312, 185 S, 323, 329, 362, 292–294, 297, 307, 314; 362/122, 123, 252, 391, 806

(56) References Cited

U.S. PATENT DOCUMENTS

| | | | |
|---|---|---|---|
| 3,623,066 | A | 11/1971 | Norris |
| 3,789,211 | A | 1/1974 | Kramer |
| 3,946,244 | A | 3/1976 | Davis, Jr. |
| 4,153,860 | A | 5/1979 | Vonick |

(Continued)

FOREIGN PATENT DOCUMENTS

| | | | |
|---|---|---|---|
| WO | WO 99/10867 | | 3/1999 |
| WO | WO 99/31560 | | 6/1999 |
| WO | WO 02/069306 | A2 | 9/2002 |
| WO | WO 02/098182 | A2 | 12/2002 |
| WO | WO 03/026358 | A1 | 3/2003 |
| WO | WO 03/055273 | A2 | 7/2003 |
| WO | WO 03/067934 | | 8/2003 |

OTHER PUBLICATIONS

Guerrero, Lucio; "End the Xmas light fight: Just leave them up"; Red Streak; Tuesday, Dec. 2, 2003; p. 6, vol. 22, No. 22, Chicago Sun–Times Inc.; Chicago, IL, USA.

(Continued)

*Primary Examiner*—Haissa Philogene
(74) *Attorney, Agent, or Firm*—John J. Oskorep, Esq.

(57) ABSTRACT

A decorative light strand has user-selectable color schemes corresponding to several holidays for year-round use. The light strand has a plurality of lights including at least one commonly-controlled set of color-controllable multi-color LEDs; a decorating selector comprising a switch which provides a plurality of user-selectable settings; and logic coupled to the switch and the plurality of lights to provide different holiday color schemes in response to the user-selectable settings. Preferably, a plurality of commonly-controlled sets of color-controllable multi-color LEDs exist along the strand, where LEDs of each set are interleaved with LEDs of other sets along the light strand. Advantageously, this light strand may be hung permanently and utilized year-round for major holidays and other suitable occasions. In a color-scheme-controllable light strand, the use of such LEDs as described reduces the number of (or eliminates) non-lit bulbs for at least some color schemes, reduces the number of wired lines to the lights, and provides the light strand with a long-life which is especially desirable in a year-round application.

32 Claims, 11 Drawing Sheets

U.S. PATENT DOCUMENTS

| | | | | |
|---|---|---|---|---|
| 4,215,277 | A | | 7/1980 | Weiner et al. |
| 4,675,575 | A | * | 6/1987 | Smith et al. ..... 315/185 S |
| 4,682,079 | A | | 7/1987 | Sanders et al. |
| 4,780,621 | A | | 10/1988 | Bartleucci et al. |
| 4,890,000 | A | | 12/1989 | Chou |
| 5,008,595 | A | | 4/1991 | Kazar |
| 5,245,519 | A | | 9/1993 | Openiano |
| 5,300,864 | A | | 4/1994 | Allen, Jr. |
| 5,359,506 | A | | 10/1994 | Koleno |
| 5,629,587 | A | | 5/1997 | Gray et al. |
| 5,747,940 | A | | 5/1998 | Openiano |
| 5,749,646 | A | | 5/1998 | Brittell |
| 5,944,408 | A | | 8/1999 | Tong et al. |
| 5,980,062 | A | | 11/1999 | Bell |
| 6,015,218 | A | | 1/2000 | Snell |
| 6,033,089 | A | | 3/2000 | Tesauro |
| 6,050,701 | A | | 4/2000 | Stone |
| 6,150,774 | A | | 11/2000 | Mueller et al. |
| 6,299,338 | B1 | | 10/2001 | Levinson et al. |
| 6,309,086 | B1 | | 10/2001 | Tomlinson |
| 6,384,545 | B1 | | 5/2002 | Lau |
| 6,424,096 | B1 | | 7/2002 | Lowe et al. |
| 6,577,080 | B2 | | 6/2003 | Lys et al. |
| 6,608,453 | B2 | | 8/2003 | Morgan et al. |
| 6,686,701 | B1 | | 2/2004 | Fullarton |
| 6,690,120 | B2 | | 2/2004 | Oskorep et al. |

OTHER PUBLICATIONS

Guerrero, Lucio; "Lights go up, never come down"; Chicago Sun–Times; Wednesday Dec. 3, 2003; p. 14, vol. 56, No. 258, Chicago Sun–Times Inc.; Chicago, IL, USA.

Mullins, Michelle; "No–fuss lighting"; Daily Southtowner; Thursday, Dec. 4, 2003; pp. B1 & B6, vol. 26, No. 282, Midwest Suburban Publishing; Chicago, IL, USA.

U.S. App. No. 10/758,143; Kazar et al; Entitled "Year–Round Decorative Lights With Addressable Color–Controllable Nodes for Selectable Holiday Color Schemes".

U.S. App. No. 10/763,658; Kazar et al; Entitled "Year–Round Decorative Lights with Time–Multiplexed Illumination Of Interleaved Sets Of Color–Controllable LEDS".

U.S. App. No. 10/731,975; Oskorep et al; Entitled "Year–Round Decorative Lights With Selectable Holiday Color Schemes".

Select pages from www.colorkinetics.com of Color Kinetics, Inc.; published at least as of Dec. 17, 2003.

* cited by examiner

FIG. 4

114 116

| R | Y | W | G | Bl | O | R | Y | W | G | Bl | O | R | Y | W | G | Bl | O | R | Y | W | G | Bl | O | R | Y | W | G | Bl | LED COLOR |
|---|---|---|---|---|---|---|---|---|---|---|---|---|---|---|---|---|---|---|---|---|---|---|---|---|---|---|---|---|---|
| | | | | | | | | | | | | | | | | | | | | | | | | | | | | | OFF |
| | | X | | | | | | X | | | | | | X | | | | | | X | | | | | | X | | | NEW YEAR'S/WHITE |
| X | | X | | | | X | | X | | | | X | | X | | | | X | | X | | | | X | | X | | | VALENTINES/SWEET |
| X | | X | | X | | X | | X | | X | | X | | X | | X | | X | | X | | X | | X | | X | | X | JULY4/MEMORIAL |
| | X | | | | X | | X | | | | X | | X | | | | X | | X | | | | X | | X | | | | HALLOWEEN |
| X | | | | | X | X | | | | | X | X | | | | | X | X | | | | | X | X | | | | | THANKSGIVING |
| X | | | X | | | X | | | X | | | X | | | X | | | X | | | X | | | X | | | X | | XMAS |
| | X | | | X | | | X | | | X | | | X | | | X | | | X | | | X | | | X | | | X | HANUKKAH |
| X | X | | | | | X | X | | | | | X | X | | | | | X | X | | | | | X | X | | | | PARTY 1 |
| | | X | | X | | | | X | | X | | | | X | | X | | | | X | | X | | | | X | | X | PARTY 2 |

"X" = ON

NO "X" = OFF

400

FIG. 5

TRUTH TABLE LOGIC

| Setting | Setting | RED | YELLOW | WHITE | GREEN | BLUE | ORANGE |
|---|---|---|---|---|---|---|---|
| New Year's/ White | 1 | 1 | 1 | 0 | 1 | 1 | 1 |
| Valentine's /Sweetest | 2 | 0 | 1 | 0 | 1 | 1 | 1 |
| July 4/ Memorial | 3 | 0 | 1 | 0 | 1 | 0 | 1 |
| Halloween | 4 | 1 | 0 | 1 | 1 | 1 | 0 |
| Thanks giving | 5 | 1 | 1 | 1 | 0 | 1 | 0 |
| Xmas | 6 | 0 | 1 | 1 | 0 | 1 | 1 |
| Hanukkah | 7 | 1 | 0 | 1 | 1 | 0 | 1 |
| Party 1 | 8 | 0 | 0 | 1 | 1 | 1 | 1 |
| Party 2 | 9 | 1 | 1 | 0 | 1 | 0 | 1 |
| OFF | 0 | 1 | 1 | 1 | 1 | 1 | 1 |

500

202 and 204

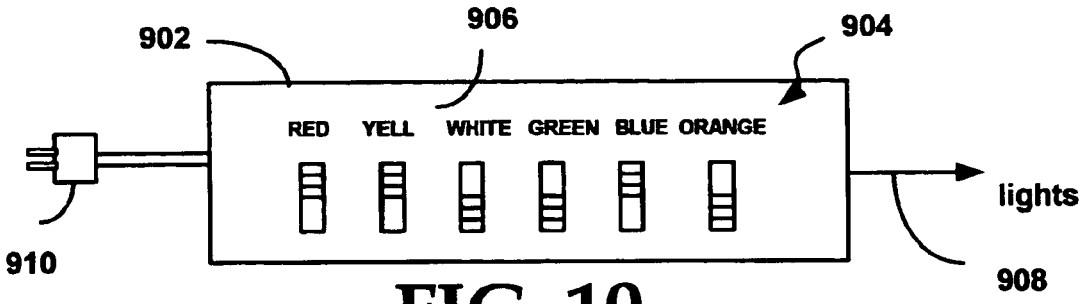
FIG. 10
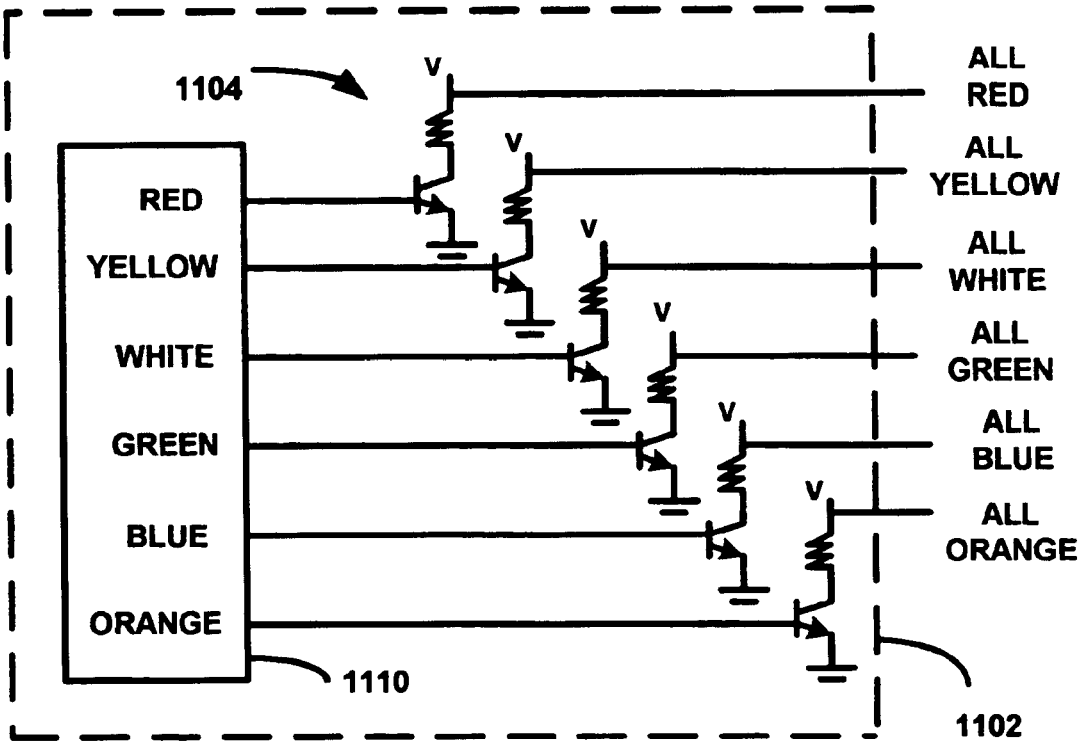
FIG. 11
FIG. 12
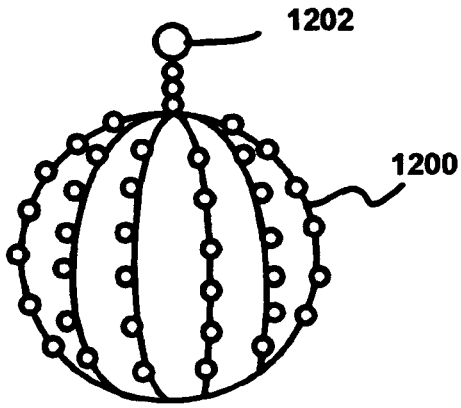

FIG. 13
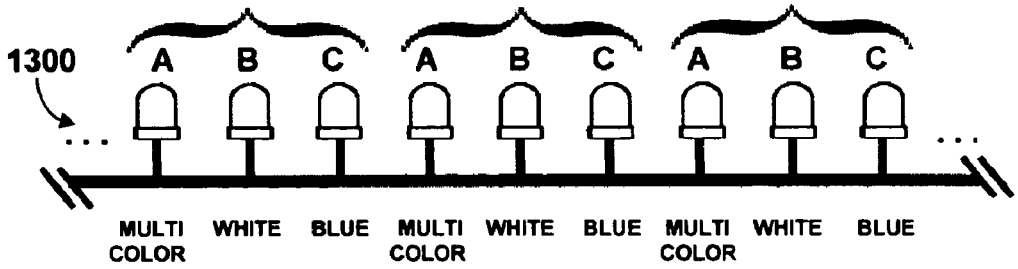
FIG. 14
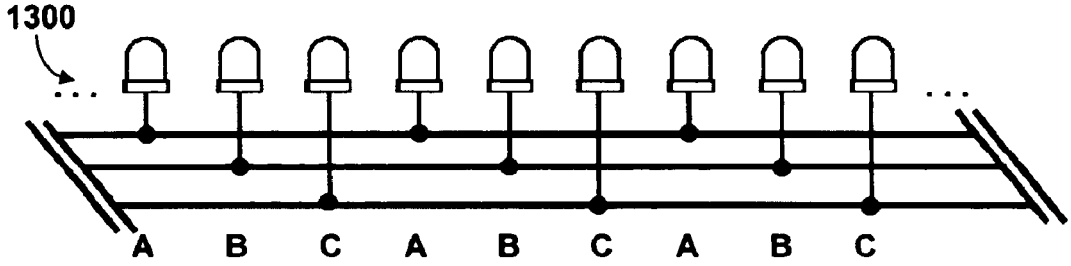
FIG. 15
| SETTING | COLOR SCHEME | | |
|---|---|---|---|
| | MULTICOLOR | WHITE | BLUE |
| New Year's Day | (Off) | White | (Off) |
| Valentine's | Red | White | (Off) |
| Easter | Yellow | White | (Off) |
| St. Patrick's | Green | White | (Off) |
| 4th of July | Red | White | Blue |
| Hanukah | Yellow | (Off) | Blue |
| Christmas | Red | (Off) | Blue |
1500

FIG. 16
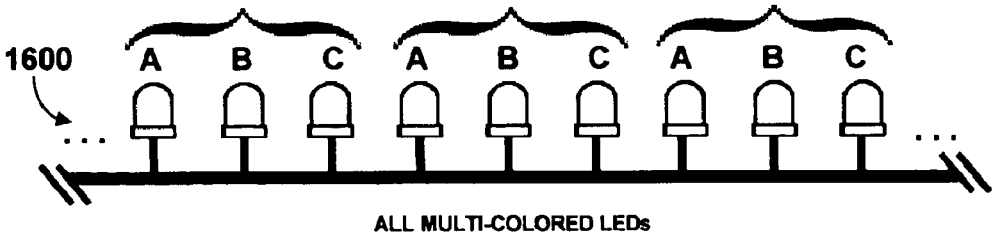
FIG. 17
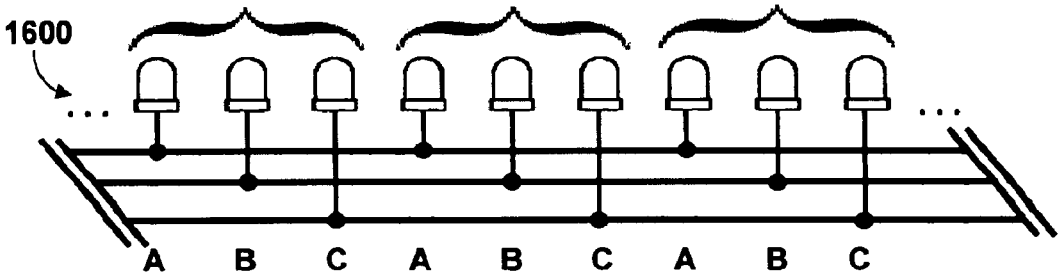
FIG. 18
| SETTING | COLOR SCHEME | | |
|---|---|---|---|
| | A | B | C |
| Christmas | Red | Green | Yellow |
| | Red | Green | Red |
| St. Patrick's Day | Green | Yellow | (Off) |
| | Green | Green | Green |
| | Green | White | (Off) |
| St. Valentine's Day | Red | Yellow | Red |
| | Red | Red | Off |
| Easter | Yellow | Yellow | Yellow |
| | Yellow | White | (Off) |
| 4th of July | Red | White | Blue |
1800

DECORATIVE LIGHTS WITH AT LEAST ONE COMMONLY CONTROLLED SET OF COLOR-CONTROLLABLE MULTI-COLOR LEDS FOR SELECTABLE HOLIDAY COLOR SCHEMES

CROSS-REFERENCE TO RELATED APPLICATIONS

This application claims priority to U.S. Provisional Patent Application No. 60/415,968 filed on Oct. 3rd, 2002 entitled "Decorative Lights With At Least One Commonly Controlled Set Of Multi-Colored LEDs For Selectable Holiday Color Schemes" and a continuation-in-part to U.S. patent application Ser. No. 10/144,149 filed on May 10, 2002 now U.S. Pat. No. 6,690,120 entitled "Year-Round Decorative Lights With Selectable Holiday Color Schemes."

BACKGROUND OF THE INVENTION

1. Field of the Invention

The present invention relates generally to decorative lights such as decorative holiday lights (e.g. Christmas lights), and more particularly to decorative light strands having controls for selecting different color schemes corresponding to major holidays and other occasions using color-controllable multi-color light-emitting diodes (LEDs).

2. Description of the Related Art

Conventional decorative lights are typically fixed in color and celebratory purpose. One type of conventional light strand includes a plurality of lights which have the same single color (e.g. all white or all red). Another conventional light strand includes a plurality of lights which are multi-color (e.g. red, green, white, blue, and yellow) and lit all at the same time. Many of these lights are suitably colored for the Christmas holidays; e.g. solid red and green, although other multi-color combinations are popular. Some light strands provide for a "flashing" or "blinking" of lights in a random or set fashion. An end-user of Christmas lights typically hangs one or more light strands for the holiday (indoors or outdoors), and takes them down and puts them into storage after the holiday is over.

Holidays other than Christmas are celebrated as well, although light strands for these occasions are difficult to find if they even exist at all. For Independence Day and Memorial Day, the color combination of red, white, and blue is popular. For Hanukkah, the colors of blue and gold are popular. For Halloween, the color combination of orange and yellow is popular. For these and other celebrated holidays, an individual often purchases different decorations just before the holiday and hangs them up. For other occasions, such as parties, birthdays, anniversaries, showers, graduations, etc., one typically has to purchase other suitable decorations and decorate with them. These decorative items are hung up for the occasion and thereafter taken down.

Prior art related to the present application includes a Christmas light strand (manufacturer unknown) which has a button switch for providing eight (8) different lighting variations. The light strand has four (4) different colored lights in the following repeated sequence: red, green, orange, and blue. The lighting variations are described as follows: 1—"COMBINATION"; 2—"IN WAVES"; 3—"TWINKLE/FLASH"; 4—"SLO-GLO"; 5—"SEQUENTIAL"; 6—"SLOW FADE"; 7—"CHASING/FLASH"; AND 8—"STEADY ON". For the 2nd, 3rd, 5th, and 7th settings, somewhat random flashing of all of the colors are provided in subtle variations. For the 4th and 6th settings, fading in and out of all of the colors (in sequence and simultaneously, respectively) are provided. All colors are lit solid in the 8th setting. Finally, the 1st setting sequences through the 1st through 7th settings. This light strand and its settings are designed solely for Christmas; no different color schemes or holiday schemes are provided. The above-described light strand is representative of such user-controllable time-sequenced lights which are suitable for Christmas or commercial applications.

Accordingly, what is needed is a decorative lighting apparatus which overcomes the deficiencies of the prior art.

SUMMARY

A decorative light strand has user-selectable color schemes corresponding to several holidays and other occasions for year-round use. The light strand has a plurality of lights including at least one commonly-controlled set of color-controllable multi-color LEDs; a decorating selector comprising a switch which provides a plurality of user-selectable settings; and logic coupled to the switch and the plurality of lights to provide different holiday color schemes in response to the user-selectable settings. Preferably, a plurality of commonly-controlled sets of color-controllable multi-color LEDs exist along the strand, where LEDs of each set are interleaved with LEDs of other sets.

Advantageously, this light strand may be hung permanently and utilized year-round for major holidays and other suitable occasions. In a color-scheme-controllable light strand, the use of such LEDs as described reduces the number of (or eliminates) non-lit bulbs for at least some color schemes, reduces the number of wired lines to the lights, and provides the light strand with a long-life which is especially desirable in a year-round application.

BRIEF DESCRIPTION OF THE DRAWINGS

FIG. 4 is a color/light enabling scheme for the representative arrangement of colored lights;

FIG. 5 is a truth table for the logic utilized in the electronics of FIG. 2;

FIG. 10 is a dip switch which may be utilized for the decorating selector for selecting the colors of the lights;

FIG. 11 is a block diagram of circuitry which may be utilized for the dip switch of FIG. 10;

FIG. 12 is an alternative decorative apparatus (i.e., a decorative holiday ball) for use in connection with the present invention;

FIG. 13 is a simplified illustration of a decorative light strand having a single set of commonly controlled multi-color light emitting diodes (LEDs);

FIG. 14 is that shown in FIG. 13 except that control lines are shown;

FIG. 15 is a table for the settings of the decorative light strand of FIGS. 13 and 14;

FIG. 16 is a simplified illustration of a decorative light strand having all commonly controlled multi-color LEDs;

FIG. 17 is that shown in FIG. 15 except that control lines are shown;

FIG. 18 is a table for the settings of the decorative light strand of FIGS. 16 and 17;

DETAILED DESCRIPTION OF THE PREFERRED EMBODIMENTS

A decorative light strand has user-selectable color schemes corresponding to several holidays and other occasions for year-round use. The light strand has a plurality of lights including at least one commonly-controlled set of color-controllable multi-color LEDs; a decorating selector comprising a switch which provides a plurality of user-selectable settings; and logic coupled to the switch and the plurality of lights to provide different holiday color schemes in response to the user-selectable settings. Preferably, a plurality of sets of color-controllable multi-color LEDs exist along the strand, where LEDs of each set are commonly controlled but interleaved with LEDs of other sets. Advantageously, this light strand may be hung permanently and utilized year-round for major holidays and other suitable occasions. In a color-scheme-controllable light strand, the use of such LEDs as described reduces the number of (or eliminates) non-lit bulbs for at least some color schemes, reduces the number of wired lines to the lights, and provides the light strand with a long-life which is especially desirable in a year-round application.

Figure 1:
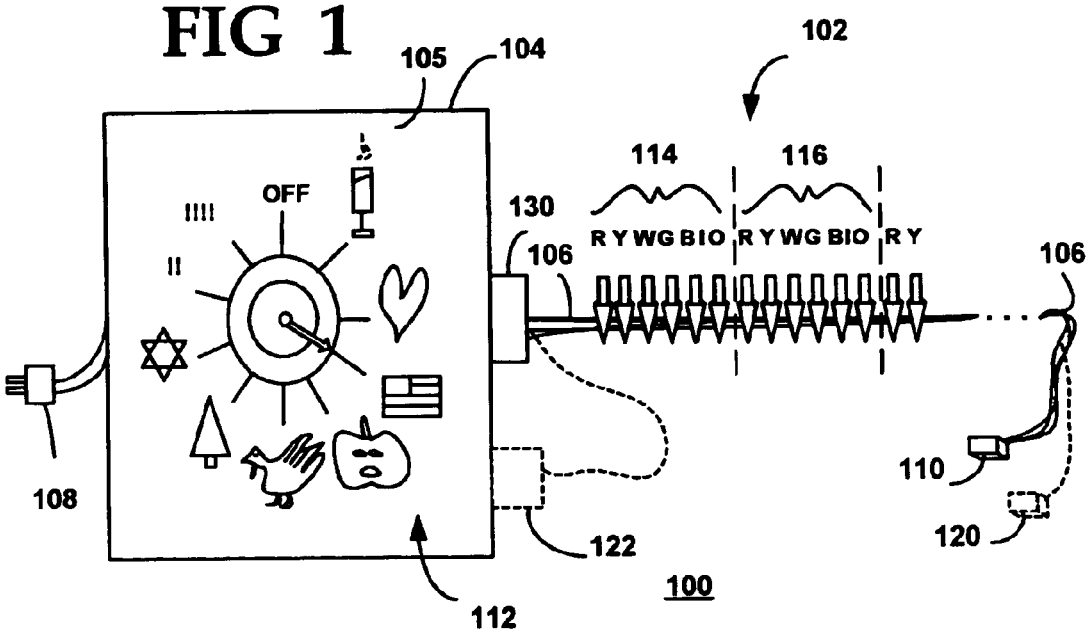
FIG. 1 is an illustration of a decorative lighting apparatus which includes a representative arrangement of colored lights and a decorating selector.

FIG. 1 is an illustration of a decorative lighting apparatus 100 which includes a representative arrangement of colored lights 102 and a decorating selector 104. Attached to decorating selector 104 is a conventional A/C power cord and plug 108 for connecting to a conventional A/C outlet for powering and illuminating colored lights 102. When decorative lighting apparatus 100 is plugged in and turned on, a plurality of wires 106 carry electrical current to light up some selected colored lights 102. Colored lights 102 may include any suitable number of different colors and, in this embodiment, colored lights 102 include six (6) colors of red (R), yellow (Y), white (W), green (G), blue (Bl), and orange (O). The light bulbs/sockets are preferably spaced relatively close to one another, for example, about 1 centimeter apart.

Colored lights 102 are positioned/sequenced by color in a predetermined manner along wires 106. In the embodiment shown in FIG. 1, the sequence is red, yellow, white, green, blue, and orange. This sequence is shown along a first light strand portion 114, which is repeated a suitable number of times along wires 106 as shown once in a second light strand portion 116.

Decorating selector 104 includes a housing 105 and a switch 112 which provides for a plurality of decorative holiday settings. In this embodiment, switch 112 is a 10-position rotary switch, single-throw. However, the number of detent positions for switch 112 may be more or less depending on how many decorative settings are desired. In an alternate embodiment, switch 112 is a conventional push-button switch which provides the plurality of different settings sequentially when pressing the button.

In this embodiment, the decorative holiday settings provided by switch 112 are provided for most major U.S. holidays. As apparent from the icons provided on housing 105 (via a plastic overlay adhesively attached on the housing), the holiday settings include (in clockwise order) a New Year's holiday setting, a Valentines/Sweetest Day holiday setting, an Independence/Memorial Day holiday setting, a Halloween holiday setting, a Thanksgiving holiday setting, a Christmas holiday setting, and a Hanukkah holiday setting. Also included are a Party-1 setting (!!) and a Party-2 setting (!!!!).

In one illustrative example, the New Year's holiday setting enables the plurality of white lights; the Valentines/Sweetest Day holiday setting enables the pluralities of red and white lights; the Independence/Memorial Day holiday setting enables the pluralities of red, white, and blue lights; the Halloween holiday setting enables the pluralities of orange and yellow lights; the Thanksgiving holiday setting enables the pluralities of orange and green lights; the Christmas holiday setting enables the pluralities of red and green lights; and the Hanukkah holiday setting enables the pluralities of blue and yellow (gold) lights. Also, the Party-1 setting enables the pluralities of red and yellow lights, and the Party-2 setting enables the pluralities of white and blue lights.

Advantageously, this strand of decorative lights can be permanently hung and utilized year-round for major holidays and/or other suitable occasions. Other suitable color schemes for each holiday may be provided; the above are merely examples. As examples, the Christmas color scheme may illuminate all of the colored lights; the Valentine's Day color scheme may illuminate red lights only; the Halloween color scheme may illuminate orange lights only or orange and white lights; etc. Also, other holidays and occasions may be provided for as well, including Easter (e.g. yellow lights; or orange and yellow lights) and St. Patrick's Day (e.g. green lights; green and white lights; or green and yellow lights).

A male connecting plug 130 is found at the front end of wires 106, and a female connecting socket 110 is found at the rear end of wires 106. Male connecting plug 130 mates with a female connecting socket provided on housing 105, which is the same type as female connecting socket 110. Female connecting socket 110 is provided so that additional colored lights of the same type may be added to the lighting strand and controlled by the same decorating selector 104.

In this embodiment, connecting plug 130 and socket 110 provide for eight (8) line connections (one control/logic line for each color, one line for A/C power, and one line for ground). With the configurations provided in FIG. 1, decorating selector 104 and colored lights 102 may be separate and independent devices and sold separately from one another. In an alternate embodiment, connecting plug 130 and socket 110 provide for only six (6) line connections (one control/logic line for each color) where lighting apparatus 100 is also equipped with a conventional A/C plug 122 and A/C socket 120 along wires 106. With this alternative approach, additional colored lights of different types may be added to the lighting strand using A/C socket 120.

Figure 2:
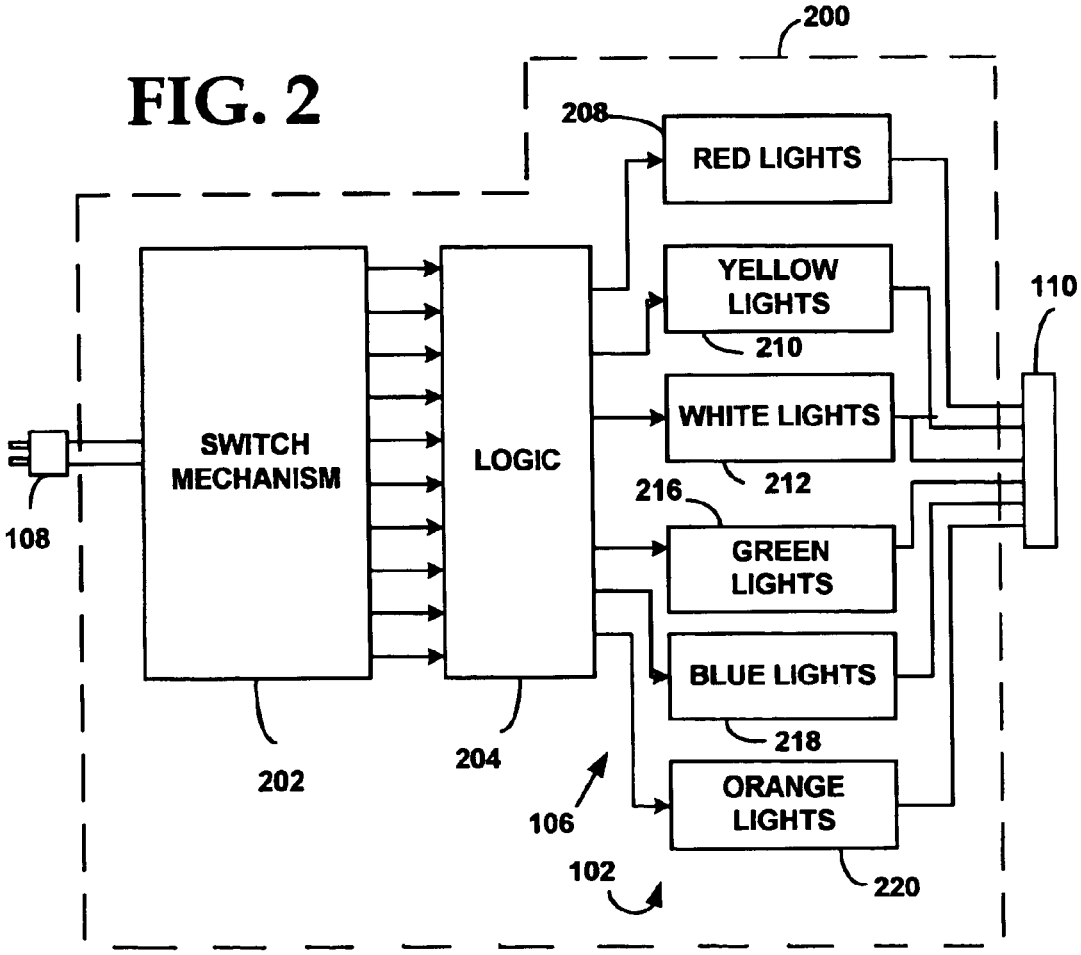
FIG. 2 is a schematic block diagram of electronics for the decorative lighting apparatus of FIG. 1.

FIG. 2 is a schematic block diagram of electronics 200 for decorative lighting apparatus 100 of FIG. 1. Electronics 200 of FIG. 2 include a switch mechanism 202, logic 204, and colored lights 102. Switch mechanism 202 has a plurality of logic outputs which change signal level based on the position of switch 112 (FIG. 1). Colored lights 102 of FIG. 2, which appear to be a single strand in FIG. 1, may actually be separately wired strands which are intertwined and include a strand of red lights 208, a strand of yellow lights 210, a strand of white lights 212, a strand of green lights 216, a strand of blue lights 218, and a strand of orange lights 220. Although each strand has a separate wire for power, they all may share the same ground wire. Each end of each separate strand of colored lights 102 is coupled to a different logic output from logic 204 so that each strand can be selectively enabled/disabled based on the position of switch 112 (FIG. 1). Logic 204 may be simple hardware gates, for example, or a microprocessor which is programmed with embedded software logic.

Figure 3A:
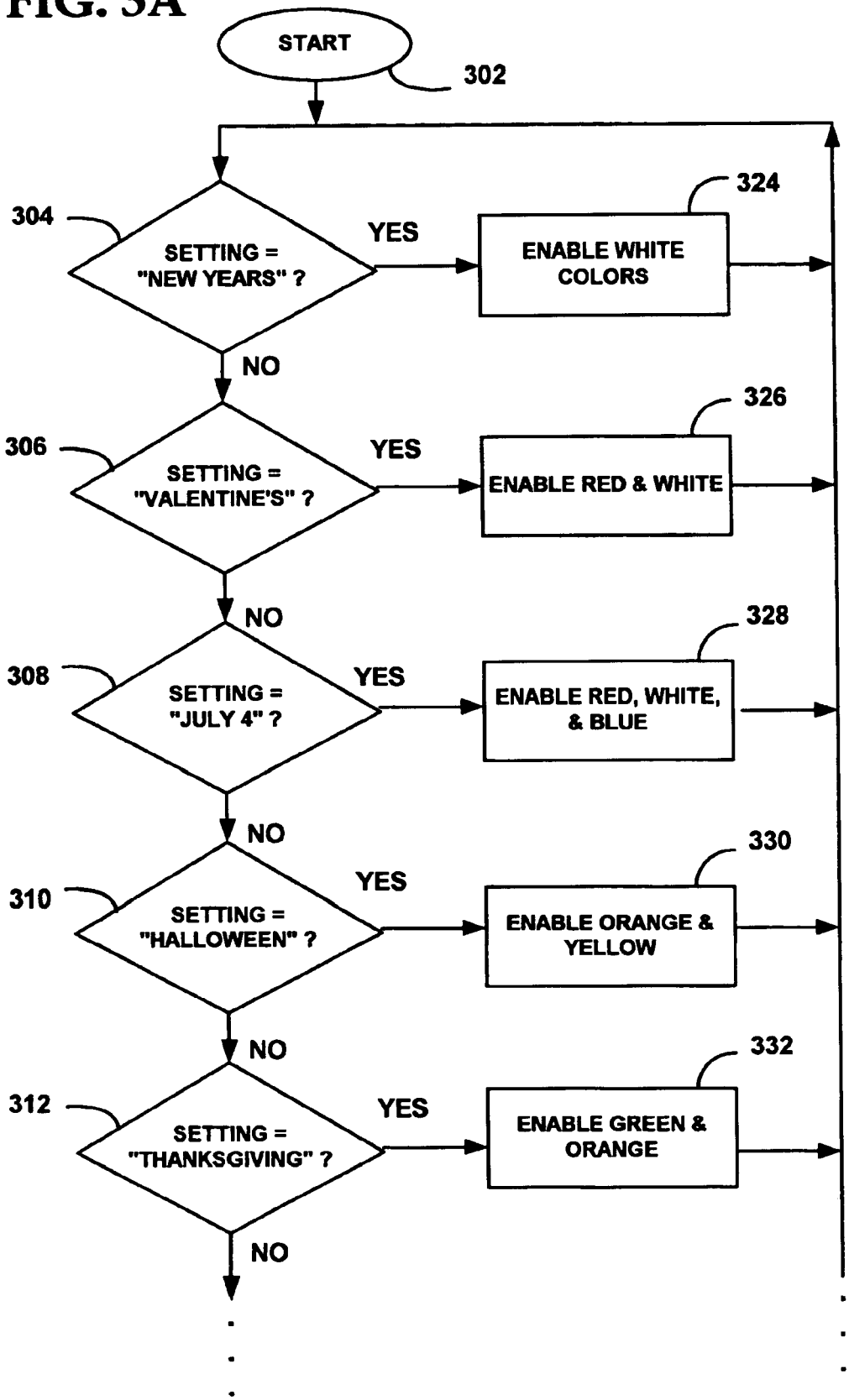
FIG. 3 is a flowchart which describes a method of selecting holiday color schemes with the decorative lighting apparatus of FIG. 1.
Figure 3B:
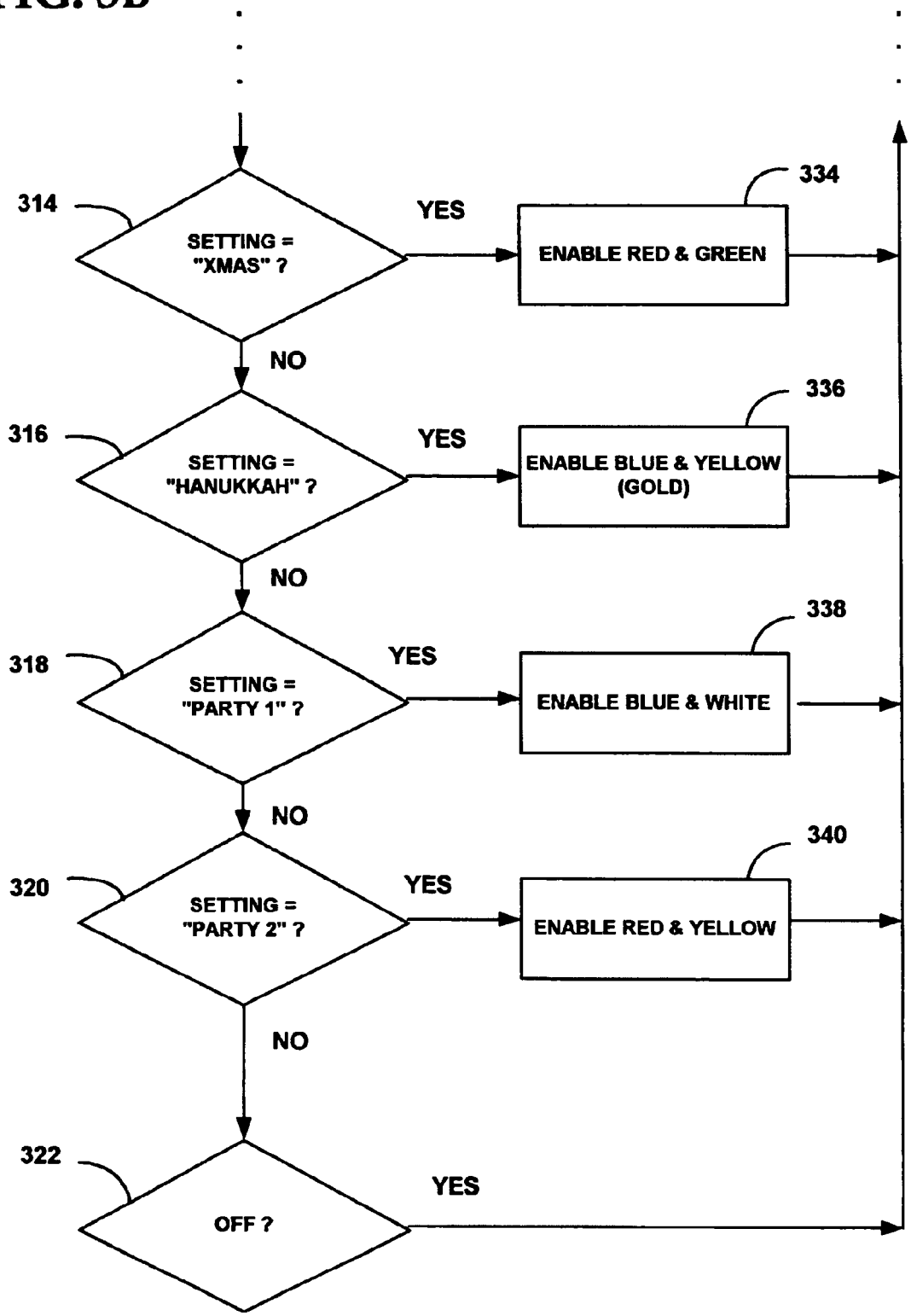

FIG. 3 is a flowchart which describes a method of selecting holiday color schemes using the decorative lighting apparatus 100 of FIG. 1. Beginning at a start block 302 in FIG. 3, if the switch setting is detected to be "New Year's" (step 304), then the logic enables the plurality of white lights only (step 324). If the switch setting is detected to be "Valentines/Sweetest Day" (step 306), then the logic enables the pluralities of red and white lights only (step 326). If the switch setting is detected to be "July 4/Memorial Day" (step 308), then the logic enables the pluralities of red, white, and blue lights only (step 328). If the switch setting is detected to be "Halloween" (step 310), then the logic enables the pluralities of orange and yellow lights only (step 330). If the switch setting is detected to be "Thanksgiving" (step 312), then the logic enables the pluralities of orange and green lights only (step 332). If the switch setting is detected to be "Christmas" (step 314), then the logic enables the pluralities of red and green lights only (step 334). If the switch setting is detected to be "Hanukkah" (step 316), then the logic enables the pluralities of blue and yellow (gold) lights only (step 336). If the switch setting is detected to be "Party-1" (step 318), then the logic enables the pluralities of red and yellow lights only (step 338). If the switch setting is detected to be "Party-2" (step 320), then the logic enables the pluralities of blue and white lights only (step 340). If the switch setting is detected to be "Off" (step 322), then no lights are enabled. The switch setting is continuously monitored so that, when set differently, the appropriate decorating lighting scheme is displayed.

FIG. 4 is a light arrangement table 400 which shows the color/light enabling scheme in the representative sequence of colored lights. Again, the representative sequence of colors shown in first and second lighting strand portions 114 and 116 is red, yellow, white, green, blue, and orange. An "X" indicates that a particular colored light is ON, whereas no "X" indicates that the particular colored light is OFF. This figure illustrates how the decorating lighting apparatus will appear when selected colors are enabled/disabled. As apparent, the sequence of colors may be important depending on the desired appearance. For example, see the appropriate spacing of colors for the "July 4$^{th}$" setting which displays red, white, and blue with a exactly single non-lit bulb space in between each lit bulb.

In FIG. 5, a truth table for the logic utilized in the electronics of FIG. 2 is shown. The logic assumes the following color-wireline order: red, yellow, white, green, blue, and orange. For the "New Year's" setting, the wired lines must be set as "110111"; for the "Valentine's" setting, the wired lines must be set as "010111"; for the "July 4" setting, the wired lines must be set as "010101"; for the "Halloween" setting, the wired lines must be set as "101110"; for the "Thanksgiving" setting, the wired lines must be set as "111010"; for the "Christmas" setting, the wired lines must be set as "011011"; for the "Hanukkah" setting, the wired lines must be set as "101101"; for the "Party-1" setting, the wired lines must be set as "001111"; for the "Party-2" setting, the wired lines must be set as "110101"; and for the "Off" setting, the wired lines must be set as "111111".

Figure 6:
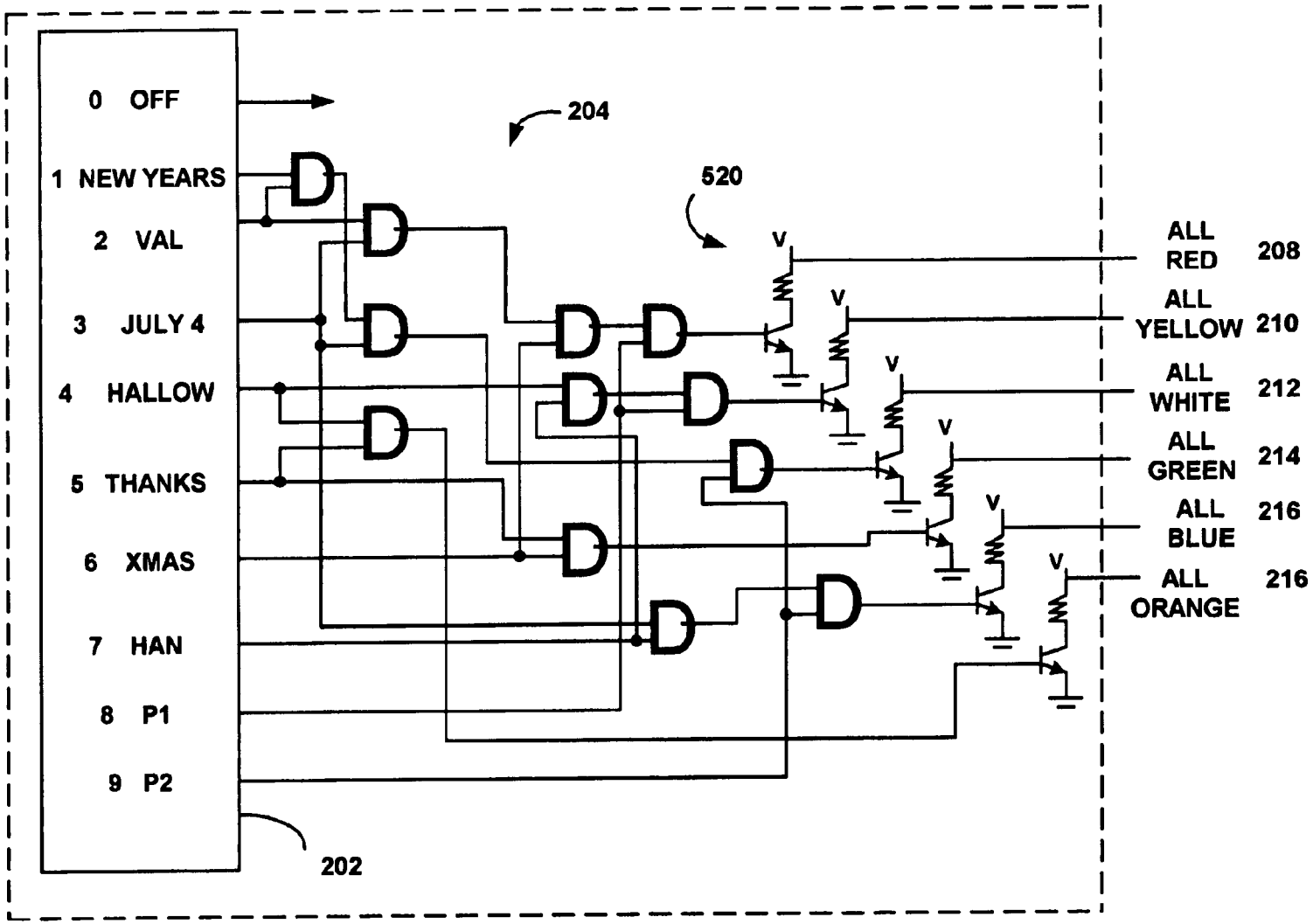
FIG. 6 is a detailed schematic diagram of the logic in the electronics of FIG. 2.

FIG. 6 is a detailed schematic diagram of the logic 204 in the electronics of FIG. 2. Switch mechanism 202 is configured such that the outputs provide the following logic: the "Off" setting=0111111111; the "New Year's" setting=1011111111; the "Valentine's" setting=1101111111; the "July 4" setting=1110111111; the "Halloween" setting=1111011111; the "Thanksgiving" setting=1111101111; the "Christmas" setting=1111110111; the "Hanukkah" setting=1111111011; the "Party-1" setting=111111101; the "Party-2" setting=1111111110. Thus, given the output logic from FIG. 5, the following relationships exist as shown in Table 1 below.

TABLE 1

Illustrative Logic.

| SWITCH OUTPUTS | COLOR STRAND ENABLE/DISABLE |
|---|---|
| 0111111111 | 111111 |
| 1011111111 | 110111 |
| 1101111111 | 010111 |
| 1110111111 | 010101 |
| 1111011111 | 101110 |
| 1111101111 | 111010 |
| 1111110111 | 011011 |
| 1111111011 | 101101 |
| 1111111101 | 001111 |
| 1111111110 | 110101 |

Logic 204 in FIG. 6 may utilize simple logic gates suitable to achieve the desired logic outputs (i.e. that shown in Table 1 above). In the embodiment shown in FIG. 6, logic 204 utilizes simple AND gates. As is apparent from the configuration of switch mechanism 202 and the logic of the AND gates, the decorative lighting apparatus will operate as previously described. In this embodiment, the colored lights are powered through switching transistors 520. However, other well-known logic and powering alternatives may be utilized. Also, as one skilled in the art will readily understand, the holiday color schemes may be enhanced by providing flickering and/or fading in and out using well-known conventional techniques.

Instead of using simple logic gates, logic 204 is alternatively a microcontroller or microprocessor programmed with embedded software to accomplish the same result. If this approach is utilized, then multiple decorative lighting strand products providing different decorative color schemes may be made using the same hardware, bulbs, and switch. The only varying aspect from product to product is the software and the plastic icon overlay utilized. In fact, the hardcoded software in read-only memory (ROM) need not be different or ever change if the microprocessor is provided or utilized with an electronically erasable/programmable ROM (EEPROM) which may be flexibly programmed and/or pre-programmed with suitable bit masks (e.g., see table 500 in FIG. 5) from product to product for selecting which colors should be lit. This alternative approach is particularly advantageous so that a variety of different product lines that differ only by software (or programmed EEPROM data) and plastic icon overlay may be easily manufactured. Thus, the logic used may be a controller, a processor, logic gates, or combinations thereof.

Figure 7:
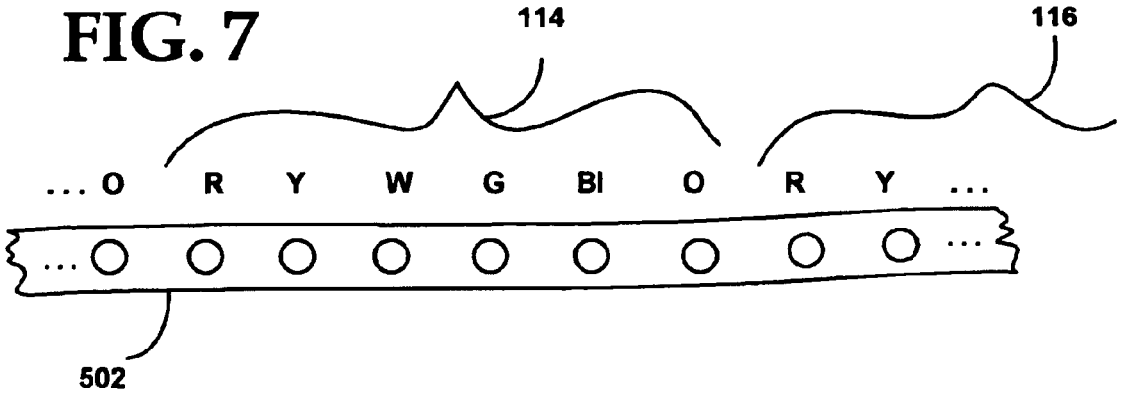
FIG. 7 is a particular embodiment where the light strand is embodied in a flexible translucent rope or tube.

FIG. 7 is an embodiment where the light strands of decorative lighting apparatus 100 of FIG. 1 are embodied in a flexible translucent rope 502 which may be made of plastic. Such rope 502 is conventionally employed in what is referred to as a "rope light", for example the Duralight Ropelight which may be obtained from DFB Sound & Light Warehouse Ltd in the United Kingdom. Containment of the bulbs and wires within such a conventional flexible translucent rope is preferable since the wires and non-lit bulbs are not readily visible.

Figure 8:
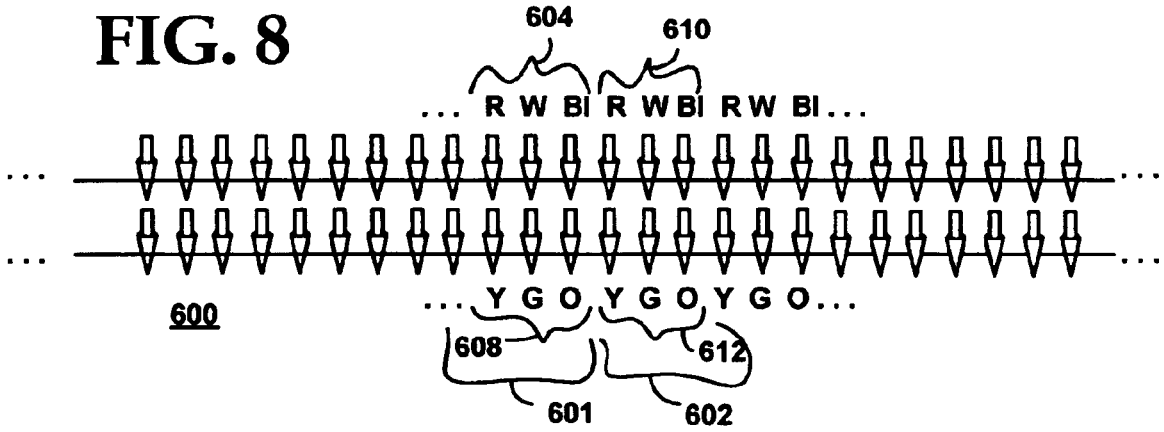
FIG. 8 is an alternative arrangement of the lights where two rows of lights are positioned side by side.
Figure 9:
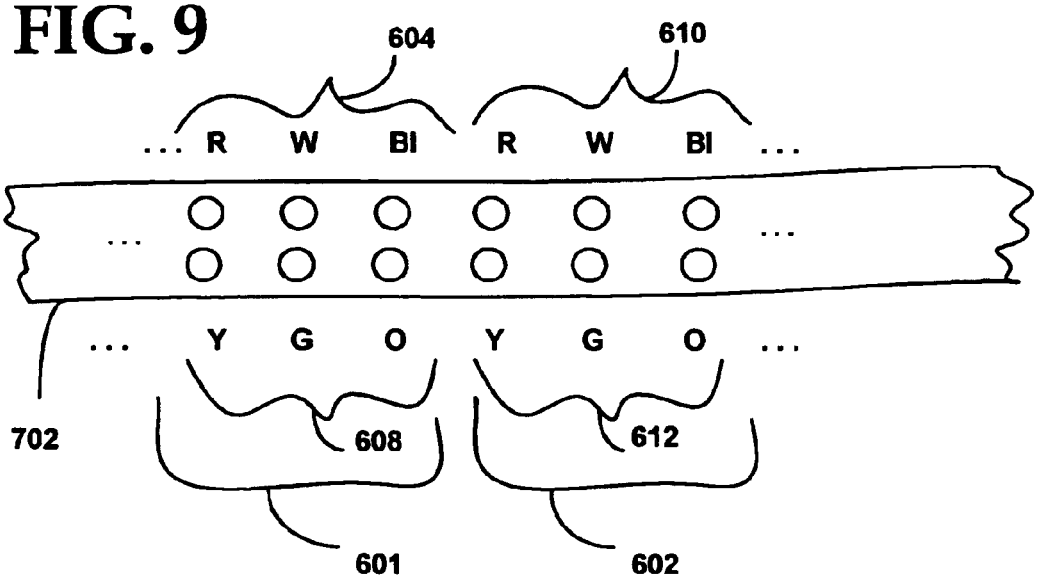
FIG. 9 is the alternative arrangement of FIG. 8 embodied in a flexible translucent rope or tube.

FIG. 8 is an alternative arrangement of the lights where two rows of lights are positioned side by side. A first light strand portion 601 includes a first row strand 604 having a first set of colors and a second row strand 608 having a second set of colors different from the first set. In this embodiment, the first set of colors of first row strand 604 are red, white, and blue, and are ordered in that manner as well. The second set of colors of second row strand 608 are yellow, green, and orange, and are ordered in that manner. FIG. 9 is the alternative arrangement of FIG. 8 embodied in a flexible translucent rope 702 ("rope lights"). The arrangement of FIGS. 8 and 9 may be preferable if even closer spacing between bulbs is desired.

FIG. 10 is a different configuration where an alternative switch 902 is utilized for the decorating selector 104 of FIG. 1 for selecting the colors of the lights. In this embodiment, switch 902 is actually a dip switch which provides for the selection of specific colors to be turned on/off A housing 906 carries the dip switch; an A/C power plug 910 is connected to housing 906 as are light strands 908. The decorative lighting apparatus in this embodiment otherwise has similar structure and functionality as that described in relation to FIGS. 1–2 and 7–9. FIG. 11 is a block diagram of circuitry 1102 which may be utilized for the dip switch of FIG. 10. Switch mechanism 1110 has logic outputs for each color, where each output is a '1' for off and a '0' for on. In this embodiment, the colored lights are powered through switching transistors 1104. However, other suitable powering alternatives may be utilized. Decorative outcomes similar to those described in relation to FIGS. 1–6 may be achieved utilizing this dip switch technique, but where the end-user has complete control over each color.

As an added feature, the light strand arrangements described herein may utilize a wireless remote control device for selecting one of the desired color schemes. In this case, a wireless receiver with antenna is coupled to the logic for receiving the wireless signal and control command from the wireless remote control device and thereafter setting the outputs to configure the appropriate color scheme.

FIG. 12 is an alternate embodiment of a decorative lighting apparatus. More particularly, FIG. 12 shows a decorative holiday ball 1200 which may be hung from a ceiling by an attachment 1202 (e.g., a chain or rope). In this embodiment, the decorative holiday ball 1200 is made from a skeletal structure of light-weight metal which is formed into a sphere. This sphere is decorated with lights, and could be decorated with other decorative materials such as decorative paper, streamers, etc. Ball 1200 is configured to function in the same manner as that described in relation to FIGS. 1–11 and is selectively illuminated with a different holiday color scheme based on the user-selectable setting. Each separate vertical strand on the sphere may have the same light color sequence as the others. Alternatively, every other strand may have the same color sequences when the two different colored strands shown and described in relation to FIG. 8 are used.

As another variation to that described in relation to FIGS. 1–11, each separate color strand does not need not be intertwined with the others such that the different colored bulbs are interleaved, but rather each color strand can be placed adjacent to one another such that the different colored bulbs are side-by-side to form a decorative 2-dimensional plane.

Figure 19:
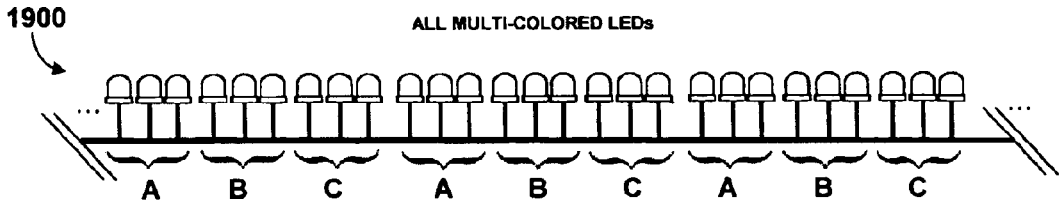
FIG. 19 is a simplified illustration of yet another decorative light strand having all commonly controlled multi-color LEDs.
Figure 20:
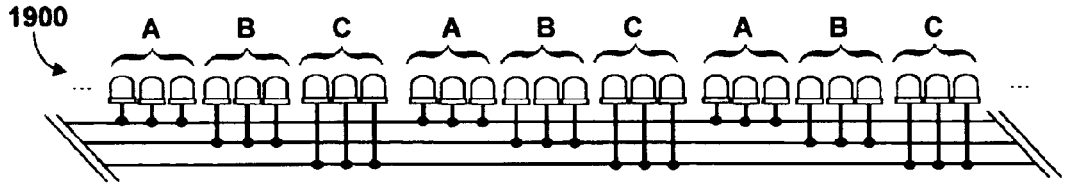
FIG. 20 is that shown in FIG. 19 except that control lines are shown.
Figure 21:
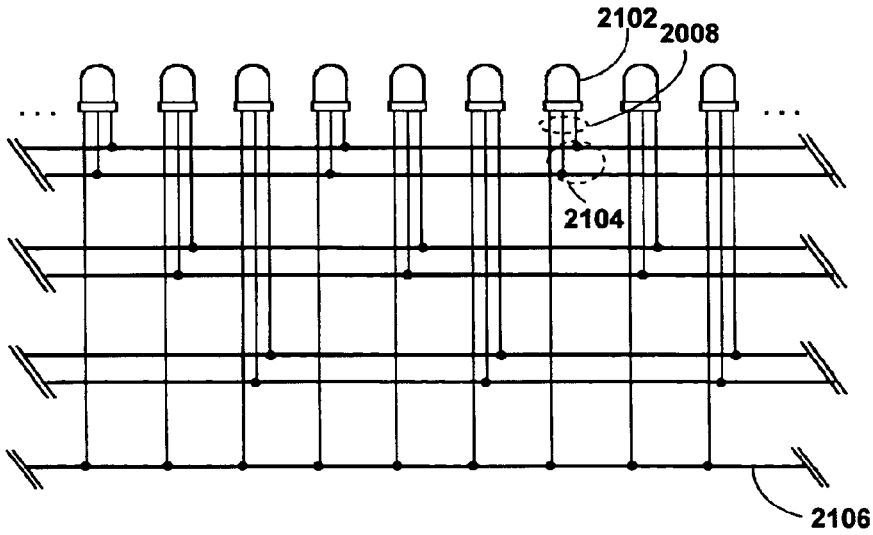
FIG. 21 is an illustration showing one way that terminals of color-controllable multi-color LEDs may be coupled to control lines.

FIGS. 13–20 are drawings for describing a few variations of decorative light strands of the present invention which utilize lights which are light emitting diodes (LEDs). More particularly, the decorative light strands described in relation to FIGS. 13–20 have at least one set of color-controllable multi-color LEDs. FIGS. 13–15 are drawings which relate to a decorative light strand which has a single set of color-controllable multi-color LEDs, each LED of which is positioned so as to be interleaved with other lights along the light strand and controlled to be illuminated with the same color which depends on the setting. FIGS. 16–18 are drawings which relate to a decorative light strand which utilizes color-controllable multi-color LEDs for all lights along the strand, where each LED of the same set is positioned so as to be interleaved with other lights along the light strand and controlled to be illuminated with the same color which depends on the setting. FIGS. 19 and 20 are drawings which relate to a decorative light strand which utilizes all color-controllable multi-color LEDs for all lights along the light strand, where LEDs of the same set are provided in contained groups which are interleaved with other light groups along the light strand and controlled to be illuminated with the same color which depends on the setting. Finally, FIG. 21 is an illustration showing one way that terminals of color-controllable multi-color LEDs may be coupled to control lines.

FIG. 13 is a simplified illustration of a decorative light strand 1300 which has lights which are all LEDs. The decorative light strand 1300 has the repeated light sequence of: "multi-color LED", "white LED", and "blue LED" along the strand. FIG. 14 is an illustration of that shown in FIG. 13 except that LEDs of the same set are revealed to be commonly controlled by the same lines. Note that each LED of each set is positioned so as to be interleaved with LEDs of other sets as shown. As apparent, the multi-color LEDs are commonly controlled as Set A, the white LEDs are commonly controlled as Set B, and the blue LEDs are commonly controlled as Set C. For example, all color-controllable multi-color LEDs are controlled by the same control line(s), all white LEDs are controlled by the same control line(s), and all blue LEDs are controlled by the same control line(s).

Sharing the same control lines, the multi-color LEDs are controlled to be illuminated with the same color which will vary depending on the particular setting that is selected. The multi-color LEDs may be of any suitable type, as a number of variations exist, and may be controlled to be ON/OFF and to be colored in accordance with simple logic or current control, as examples. The color controllable multi-color LEDs may be all bi-color LEDs (e.g. red & green, or red & yellow, etc.), all tri-color LEDs (e.g. red, green, and blue), or all "all color" LEDs which provide for all different colors. Referring ahead to FIG. 21, an illustration which shows one way that terminals of color-controllable multi-color LEDs may be coupled to control lines is provided. Other configurations may be suitable depending on the type of color-controllable multi-color LED utilized as one skilled in the art will readily appreciate. Color-controllable multi-color LED 2102 of FIG. 21 may have three terminals 2008, two terminals of which are for control and one terminal of which is grounded at a reference voltage line 219. The two control terminals of LED 2102 are coupled to two control lines, respectively, associated with the same set (e.g. Set A). Such an LED 2102 may be a bi-color LED which is controllable to be off (logic "00"), red (logic "10"), or green (logic "01") (for example) or a bi-color of LED which is controllable to be off (logic "00"), red (logic "10"), green (logic "01"), or yellow (logic "11") (for example). Color-controllable multi-color LED 2102 of FIG. 21 may be representative of other color-controllable multi-color LEDs in the light strand which may be similarly coupled.

Referring now to FIG. 15, a table 1500 which describes a few different holiday switch settings for the light strand of FIGS. 13–14 and which LEDs are illuminated in response to each setting is shown. Table 1500 also shows which color is selected for the multi-color LED set. In addition, Table 2 below provides exemplary logic for the light strand of FIGS. 13–15 assuming that the color-controllable multi-color LED (Set A) utilizes a bi-color LED (off, red, green, or yellow) having control lines A1 and A2.

TABLE 2

Illustrative Logic Using Color-Controllable Multi-Color LEDs

| Setting | Control Logic For Set A (Bi-Color) A1 | Control Logic For Set A (Bi-Color) A2 | Control Logic For Set B (White) | Control Logic For Set C (Blue) |
|---|---|---|---|---|
| New Year | 0 | 0 | 1 | 0 |
| Valentine | 1 | 0 | 1 | 0 |
| Easter | 1 | 1 | 1 | 0 |
| St. Patrick | 0 | 1 | 1 | 0 |
| July 4th | 1 | 0 | 1 | 1 |
| Hanukah | 1 | 1 | 0 | 1 |
| Christmas | 1 | 0 | 0 | 1 |

FIG. 16 is a simplified illustration of a decorative light strand 1600 which has lights which are all color-controllable multi-color LEDs. Each color controllable multi-color LED may be a bi-color LED (e.g. red & green, or red & yellow, etc.), a tri-color LED (e.g. red, green, and blue), or an "all color" LEDs which provides for all different colors. Not that each LED of each set is positioned so as to be interleaved with LEDs of other sets as shown. FIG. 17 is an illustration of that shown in FIG. 16 except that LEDs of the same set (e.g. three sets including set A, set B, and set C) are revealed to be commonly controlled by the same lines. For example, all Set A LEDs are controlled by the same control line(s), all Set B LEDs are controlled by the same control line(s), and all Set C LEDs are controlled by the same control line(s). Sharing the same control lines, each multi-color LED of the same set are controlled to be illuminated with the same color which will vary depending on the particular setting that is selected.

FIG. 18 is a table 1800 which shows a few different holiday switch settings for the light strand of FIGS. 16 and 17, and which colors are selected and illuminated for Sets A, B, and C LEDs in response to each setting. Table 1800 in FIG. 18 also shows a few different color scheme options which may be used for the same holiday. Note that some LED sets may be switched off, and some LED sets may be controlled to have the same color as other LED sets. In this case, as shown, the same color may be provided in two different sets of LEDs (e.g. for Christmas, the color red may be provided for both Set A and Set C LEDs; for Easter, the color yellow may be provided for both Set A and Set C LEDs; etc.). Table 3 below provides some exemplary logic for the light strand of FIGS. 16–18 assuming that all color-controllable multi-color LEDs (Sets A, B, and C) utilize a tri-color LED (off, red, green, or yellow) having two separate control lines.

TABLE 3

Illustrative Logic Using All Color-Controllable Multi-Color LEDs

| Setting | A1 | A2 | B1 | B2 | C1 | C2 |
|---|---|---|---|---|---|---|
| Christmas | 1 | 0 | 0 | 1 | 1 | 1 |
| St. Patrick | 0 | 1 | 1 | 1 | 0 | 0 |
| Valentine | 1 | 0 | 1 | 1 | 1 | 0 |
| Easter | 1 | 1 | 1 | 1 | 1 | 1 |

FIG. 19 is a simplified illustration of a decorative light strand 1900 which includes LEDs, and more specifically all color-controllable multi-color LEDs. The color controllable multi-color LEDs may be all bi-color LEDs (e.g. red & green, or red & yellow, etc.), all tri-color LEDs (e.g. red, green, and blue), or all "all color" LEDs which provide for all different colors. FIG. 20 is an illustration of that shown in FIG. 19 except that it shows that the LEDs are part of commonly controlled sets (e.g. three sets including set A, set B, and set C) which are controlled by the same line(s). For example, all Set A LEDs are controlled by the said control line(s), all Set B LEDs are controlled by the same control line(s), and all Set C LEDs are controlled by the same control line(s). The difference between FIGS. 19–20 and FIGS. 1–17 is that FIGS. 19–20 have multiple LEDs of the same set being physically grouped along the light strand in a consecutive fashion. In this example, there are three consecutive LEDs of the same set along the strand, for each set. Table 1800 of FIG. 18 shows a few different holiday switch settings for the light strand of FIGS. 19 and 20 along with which colors are selected and illuminated for Sets A, B, and C LEDs in response to each setting.

Several variations exist for that described in relation to FIGS. 13–20. The LEDs may be grouped in a greater number than 3 groups or lesser number than 3 groups (e.g. 2 groups). In FIG. 20, each consecutive LED set may have a greater number than 3 LEDs or lesser number than 3 LEDs (e.g. 2 LEDs). The decorative light strands may provide for all major holidays as described herein.

Advantageously, the light strand may be hung permanently and utilized year-round for major U.S. holidays and other suitable occasions. In a color-scheme-controllable light strand, the use of such LEDs as described reduces the number of (or eliminates) non-lit bulbs for at least some color schemes, reduces the number of wired lines to the lights, and provides the light strand with a long-life which is especially desirable in a year-round application.

It is to be understood that the above is merely a description of preferred embodiments of the invention and that various changes, alterations, and variations may be made without departing from the true spirit and scope of the invention as set for in the appended claims. The several embodiments and variations described above can be combined with each other where suitable. The particular color schemes for the holidays described herein are merely examples and may vary. Also, instead of providing U.S. holiday schemes, the settings may be suitable to provide a plurality of different geographical regional color schemes such as different flag colors for different states or countries (France, Germany, Italy, etc.) or different holiday schemes for non-U.S. country. Alternatively, the settings may provide color schemes which correspond to a plurality of different sports teams such as different football teams (Chicago Bears, New York Giants, San Diego Chargers, etc.), baseball teams, soccer teams, hockey teams, etc. None of the terms or phrases in the specification and claims has been given any special particular meaning different from the plain language meaning to those skilled in the art, and therefore the specification is not to be used to define terms in an unduly narrow sense.

What is claimed is:

1. A decorative lighting apparatus, comprising:

a light strand having a plurality of lights including a first commonly-controlled set of color-controllable multi-color light-emitting diodes (LEDs) and a second set of commonly-controlled LEDs;

a decorating selector comprising a switch which provides a plurality of user-selectable settings;

logic which controls the plurality of lights including the first commonly-controlled set of color-controllable multi-color LEDs and the second set of commonly-controlled LEDs;

the logic being configured to selectively illuminate the plurality of lights with a different holiday color scheme for each user-selectable setting of the switch, such that at least some of the different holiday color schemes comprise at least two colors in the first and the second sets of LEDs which are simultaneously illuminated along the light strand.

2. The decorative lighting apparatus of claim 1, wherein the user-selectable settings provide at least three different holiday color schemes associated with three different U.S. holidays.

3. The decorative lighting apparatus of claim 1, wherein the user-selectable settings provide a plurality of different holiday color schemes associated with at least three different U.S. holidays selected from the following list: Christmas, Independence Day, Valentine's Day, Halloween, and St. Patrick's Day.

4. The decorative lighting apparatus of claim 1, wherein the user-selectable settings provide a plurality of different holiday color schemes associated with major U.S. holidays including Christmas and Independence Day.

5. The decorative lighting apparatus of claim 1, further comprising:

each LED in the at least one commonly-controlled set being positioned along the light strand so as to be interleaved with other LEDs in the plurality of lights.

6. The decorative lighting apparatus of claim 1, further comprising:

each LED of each set being interleaved with LEDs of other sets along the light strand in a fixed repeated sequence.

7. The decorative lighting apparatus of claim 1, further comprising:

wherein the user-selectable settings provide at least three different holiday color schemes associated with three different U.S. holidays.

8. The decorative lighting apparatus of claim 1, further comprising:

wherein the light strand having the plurality of lights includes at least one commonly-controlled set of fixed-color LEDs.

9. The decorative lighting apparatus of claim 1, further comprising:

the logic comprising a microprocessor;

microprocessor instructions programmed in the microprocessor for:

reading each user-selectable setting of the switch; and providing an output for the selective illumination of the plurality of lights.

10. The decorative lighting apparatus of claim 1, wherein the color-controllable multi-color LEDs comprise bi-color LEDs.

11. The decorative lighting apparatus of claim 1, wherein the color-controllable multi-color LEDs comprise tri-color LEDs.

12. The decorative lighting apparatus of claim 1, wherein the switch comprises a plurality of switches corresponding to a plurality of colors.

13. A method of providing a decorative lighting apparatus with a plurality of different U.S. holiday color schemes, comprising the acts of:

providing the decorative lighting apparatus with a first commonly controlled set of color-controllable light emitting diodes (LEDs);

providing the decorative lighting apparatus with a second commonly controlled set of LEDs adjacent the first commonly controlled set of color-controllable LEDs;

providing for a selective illumination of light colors in the decorative lighting apparatus in accordance with a first U.S. holiday color scheme, in response to a first user switch setting of the decorative lighting apparatus;

providing for a selective illumination of light colors in the decorating lighting apparatus in accordance with a second U.S. holiday color scheme, in response to a second user switch setting of the decorative lighting apparatus;

wherein the first commonly controlled set of color-controllable LEDs is illuminated with a first color in the first U.S. holiday color scheme and the second commonly controlled set of LEDs is illuminated with a second color in the first U.S. holiday color scheme, such that the first and the second colors are simultaneously illuminated for the first U.S. holiday color scheme; and wherein the first commonly controlled set of color-controllable LEDs is illuminated with a third color in the second U.S. holiday color scheme which is different from the first color in the first U.S. holiday color scheme and the second commonly controllable set of LEDs is illuminated with the second color in the second U.S. holiday color scheme, such that the second an the third colors are simultaneously illuminated for the second U.S. holiday color scheme.

14. The method of claim 13, wherein the second set of commonly controlled LEDs comprises color-controllable LEDs.

15. The method of claim 13, further comprising:

providing for a selective illumination of light colors in the decorating lighting apparatus in accordance with a third U.S. holiday color scheme, in response to a third user switch setting of the decorative lighting apparatus.

16. The method of claim 13, wherein the second commonly controlled set of LEDs comprises fixed-color LEDs.

17. The method of claim 13, wherein the first U.S. holiday color scheme is Christmas and the second U.S. holiday color scheme is Valentine's Day.

18. The method of claim 13, wherein the first U.S. holiday color scheme is Christmas and the second U.S. holiday color scheme is St. Patrick's Day.

19. The method of claim 13, wherein the color-controllable LEDs comprise tri-color LEDs.

20. The method of claim 13, wherein each user switch setting corresponds to setting a plurality of switches corresponding to a plurality of colors.

21. The method of claim 13, wherein the decorative lighting apparatus comprises a decorative light strand having the first commonly controlled set of color-controllable LEDs positioned therealong and the second commonly controlled set of LEDs positional therealong.

22. The method of claim 13, further comprising:

wherein the decorative lighting apparatus comprises a decorative light strand having the first commonly controlled set of color-controllable multi-color LEDs positioned therealong and the second commonly controlled set of LEDs positioned therealong;

wherein the color-controllable LEDs comprise tri-color LEDs;

wherein the first U.S. holiday color scheme corresponds to one of the following holidays: Christmas, St. Valentine's Day, St. Patrick's Day, Independence Day, and Easter; and wherein the second U.S. holiday color scheme corresponds to one of the following holidays: Christmas, St. Valentine's Day, St. Patrick's Day, Independence Day, and Easter.

23. The method of claim 13, further comprising:

providing for a selective illumination of light colors in the decorating lighting apparatus in accordance with a third U.S. holiday color scheme, in response to a third user switch setting of the decorative lighting apparatus;

wherein the decorative lighting apparatus comprises a decorative light strand having the first commonly controlled set of color-controllable multi-color LEDs positioned therealong and the second commonly controlled set of LEDs positioned therealong;

wherein the color-controllable LEDs comprise tri-color LEDs;

wherein the first and the second set of LEDs are interleaved in a fixed repeated sequence;

wherein the first U.S. holiday color scheme corresponds to one of the following holidays: Christmas, St. Valentine's Day, St. Patrick's Day, Independence Day, and Easter;

wherein the second U.S. holiday color scheme corresponds to one of the following holidays: Christmas, St. Valentine's Day, St. Patrick's Day, Independence Day, and Easter; and wherein the third U.S. holiday color scheme corresponds to one of the following holidays: Christmas, St. Valentine's Day, St. Patrick's Day, Independence Day, and Easter.

24. The method of claim 13, wherein the color-controllable LEDs comprise bi-color LEDs.

25. A decorative lighting apparatus, comprising:

an alternating current (AC) plug for use in supplying electrical power to the decorative lighting apparatus;

at least two light strands including:

a first light strand having a first set of lights in the form of a first commonly-controlled set of color-controllable light-emitting diodes (LEDs);

a second light strand having a second set of lights in the form of a second commonly-controlled set of LEDs;

a decorating selector comprising a switch which provides a plurality of user-selectable settings for the decorative lighting apparatus;

logic which controls the at least two light strands via control lines;

the logic being configured to selectively illuminate the light strands with a different color scheme for each user-selectable setting of the switch, such that:

a first holiday color scheme has a first color illuminated in the first commonly-controlled set of color-controllable LEDs and a second color illuminated in the second commonly-controlled set of LEDs which is simultaneously illuminated with the first color; and a second holiday color scheme has a third color illuminated in the first commonly-controlled set of color-controllable LEDs and the second color illuminated in the second commonly-controlled set of LEDs which is simultaneously illuminated with the third color.

26. The decorative lighting apparatus of claim 25, wherein the at least two light strands are intertwined together in a liner fashion and the second commonly-controlled set of LEDs comprises fixed-color LEDs.

27. The decorative lighting apparatus of claim 25, wherein the second light strand having the second set of lights is in the form of a commonly-controlled set of color-controllable LEDs.

28. The decorative lighting apparatus of claim 25, wherein the logic is configured so as to provide the first holiday color scheme as a Christmas holiday color scheme and the second U.S. holiday color scheme as a different holiday color scheme.

29. The decorative lighting apparatus of claim 25, further comprising:

wherein the logic is further configured to provide a third holiday color scheme;

wherein the logic is further configured so as to provide the first holiday color scheme as a Christmas holiday color scheme; and wherein the logic is further configured so as to provide the second and third holiday color schemes as holiday color schemes selected from the following list: New Year's Day, St. Valentine's Day, St. Patrick's Day, Independence Day, Halloween, Easter, and Thanksgiving.

30. A decorative lighting apparatus, comprising:

a decorative light strand having a plurality of commonly-controllable sets of color-controllable multi-color light-emitting diodes (LEDs);

a decorating selector comprising a switch which provides a plurality of user-selectable settings for the decorative lighting apparatus;

logic comprising a controller;

the controller being operative in accordance with software instructions to illuminate the decorative light strand with a different color scheme for each user-selectable setting of the switch, such that:

a first holiday color scheme has a first color illuminated in the plurality of commonly-controlled sets of color-controllable multi-color LEDs and corresponds to one of the following holidays: Christmas, St. Valentine's Day, St. Patrick's Day, Independence Day, and Easter;

a second holiday color scheme has a second color illuminated in the plurality of commonly-controlled sets of color-controllable multi-color LEDs and corresponds to one of the following holidays: Christmas, St. Valentine's Day, St. Patrick's Day, Independence Day, and Easter; and a third holiday color scheme has a third color illuminated in the plurality of commonly-controlled sets of color-controllable multi-color LEDs and corresponds to one of the following holidays: Christmas, St. Valentine's Day, St. Patrick's Day, Independence Day, and Easter.

31. The decorative lighting apparatus of claim 30, wherein each holiday color scheme comprises at least two colors illuminated along the decorative light strand.

32. The decorative lighting apparatus of claim 30, wherein the multi-color LEDs comprise one of bi-color LEDs and tri-color LEDs.

* * * * *